US008241136B2

(12) United States Patent
Bennett

(10) Patent No.: US 8,241,136 B2
(45) Date of Patent: Aug. 14, 2012

(54) METHOD OF GAMING, A GAMING SYSTEM, AND A GAMING APPARATUS

(75) Inventor: Nicholas Luke Bennett, Manly Vale (AU)

(73) Assignee: Aristocrat Technologies Australia Pty Limited, North Ryde, NSW (AU)

( * ) Notice: Subject to any disclaimer, the term of this patent is extended or adjusted under 35 U.S.C. 154(b) by 543 days.

(21) Appl. No.: 12/365,553

(22) Filed: Feb. 4, 2009

(65) Prior Publication Data

US 2009/0233697 A1 Sep. 17, 2009

(30) Foreign Application Priority Data

Feb. 4, 2008 (AU) ..... 2008900490

(51) Int. Cl.
*A63D 15/00* (2006.01)
*A63D 15/20* (2006.01)

(52) U.S. Cl. ..... 473/23; 473/4; 473/53; 463/23; 463/27

(58) Field of Classification Search ..... 463/25; 473/4, 23, 53
See application file for complete search history.

(56) References Cited

U.S. PATENT DOCUMENTS

| | | | | |
|---|---|---|---|---|
| 4,516,770 | A | 5/1985 | Brookes et al. | |
| 5,026,053 | A * | 6/1991 | Paterson et al. | 473/23 |
| 5,066,008 | A * | 11/1991 | Rivera | 473/23 |
| 6,276,689 | B1 | 8/2001 | Brown | |
| 6,875,120 | B1 * | 4/2005 | Ellis | 473/2 |
| 7,063,620 | B2 * | 6/2006 | Nearhood | 473/2 |
| 2004/0053686 | A1 | 3/2004 | Pacey et al. | |
| 2005/0037832 | A1 | 2/2005 | Cannon | |
| 2006/0003830 | A1 | 1/2006 | Walker et al. | |
| 2006/0063599 | A1 * | 3/2006 | Greenspan | 473/1 |
| 2006/0154718 | A1 * | 7/2006 | Willyard et al. | 463/25 |
| 2006/0199656 | A1 | 9/2006 | McGovern | |
| 2006/0276271 | A1 | 12/2006 | Hamann | |
| 2007/0026956 | A1 | 2/2007 | Pearson | |
| 2007/0066411 | A1 | 3/2007 | Gulyassy | |
| 2007/0102877 | A1 | 5/2007 | Personius et al. | |

(Continued)

FOREIGN PATENT DOCUMENTS

| | | |
|---|---|---|
| EP | 1759743 | 3/2007 |

(Continued)

OTHER PUBLICATIONS

Australian Government: IP Australia, "Examiner's First Report," issued in connection with AU Patent Application No. 2009200364, mailed on Jun. 9, 2010, 4 pages.

*Primary Examiner* — Zandra Smith
*Assistant Examiner* — Tsz Chiu
(74) *Attorney, Agent, or Firm* — Hanley, Flight & Zimmerman, LLC

(57) ABSTRACT

A method of gaming comprising: providing a table game of the type where a player seeks to sink one or more balls of a set of balls in one or more pockets of the table by striking the balls with a cue ball in accordance with the rules of the table game; receiving a wager from a player additional to any amount required to play the table game, the wager entitling the player to receive at least one bonus associated with an event if the player achieves the event; and electronically monitoring play of the table game to determine whether the player achieves the event and the bonus should be awarded to the player.

33 Claims, 7 Drawing Sheets

U.S. PATENT DOCUMENTS

| | | | | |
|---|---|---|---|---|
| 2007/0155519 | A1 | 7/2007 | Panzica | |
| 2008/0182675 | A1 * | 7/2008 | Flores | 473/27 |

FOREIGN PATENT DOCUMENTS

| | | |
|---|---|---|
| GB | 2432126 | 5/2007 |
| JP | 2007029752 | 2/2007 |
| KR | 20010069888 | 7/2001 |
| WO | 0126760 | 4/2001 |
| WO | WO007009188 | 1/2007 |
| WO | 2008099194 | 8/2008 |

* cited by examiner

METHOD OF GAMING, A GAMING SYSTEM, AND A GAMING APPARATUS

CROSS-REFERENCE TO RELATED APPLICATIONS

The present application claims the benefit of priority to Australian Provisional Patent Application No. 2008900490, filed on Feb. 4, 2008, entitled "A METHOD OF GAMING, A GAMING SYSTEM AND A GAMING APPARATUS", which is herein incorporated by reference in its entirety.

FIELD

The invention relates to a method of gaming, a gaming system, and a gaming apparatus.

BACKGROUND

Pool tables are used by players to play table games which have as their object, the sinking of balls in pockets of the pool table in accordance with the rules of the game. Typically, players strike a cue ball with a cue to attempt to cause a target ball to be sunk in one of the pockets.

Virtual pool table games are also known, where a player operates electronic controls to attempt to strike and sink balls on a virtual representation of a pool table.

There is a need to provide further enjoyment in relation to table games.

SUMMARY OF THE INVENTION

In a first aspect, the invention provides a method of gaming including:

providing a table game of the type where a player seeks to sink one or more balls of a set of balls in one or more pockets of the table by striking the balls with a cue ball in accordance with the rules of the table game;

receiving a wager from a player additional to any amount required to play the table game, the wager entitling the player to receive at least one bonus associated with an event if the player achieves the event; and electronically monitoring play of the table game to determine whether the player achieves the event and the bonus should be awarded to the player.

In an embodiment, there are a plurality of bonuses associated with respective ones of a plurality of different events.

In an embodiment, an event includes a plurality of sub-events.

In an embodiment, the method includes notifying each event to the player prior to commencement of play of the table game.

In an embodiment, the method includes notifying each event to the player subsequent to receipt of the wager.

In an embodiment, the method includes notifying the player of an opportunity to achieve an event and receiving the wager as a response to the offer.

In an embodiment, different wager amounts entitle the player to play for different bonuses.

In an embodiment, the table game is provided as a video game implemented by a game controller having an associated player interface including a display for displaying the table game and a game play mechanism operable by the player to make a wager and play the game.

In an embodiment, the table game is provided as a physical table, the method further including providing a monitoring mechanism arranged to monitor for the event, a game play mechanism operable by the player to make a wager, and a game controller arranged to make the bonus award to the player if the player achieves the event.

In an embodiment, the event is selected from the group including:

the order in which the balls are sunk into any of the pockets;

the order in which the balls are sunk into specific pockets;

the order in which a certain subset of the balls are sunk into any pocket; and the order in which a certain subset of balls are sunk into specific pockets.

In a second aspect, the invention provides a gaming system including:

a player interface including a display and a game play mechanism;

a game controller arranged to:

conduct a table game and display the table game on the display, the table game being of the type where a player seeks to sink one or more balls of a set of balls in one or more pockets of the table by striking the balls with a cue ball in accordance with the rules of the table game by operating the game play mechanism;

receive a wager from a player additional to any amount required to play the table game, the wager entitling the player to receive at least one bonus associated with an event if the player achieves the event; and monitor play of the table game to determine whether the player achieves the event and the bonus should be awarded to the player.

In an embodiment, the game controller includes a table game play implementer arranged to implement play of the table game.

In an embodiment, the game controller includes an event monitor arranged to monitor for the occurrence of an event.

In an embodiment, the game controller includes a bonus awarder arranged to make an award to the player.

In an embodiment, there are a plurality of bonuses associated with respective ones of a plurality of different events.

In an embodiment, an event includes a plurality of sub-events.

In an embodiment, the gaming system is arranged to notify each event to the player prior to commencement of play of the table game.

In an embodiment, the gaming system is arranged to notify each event to the player subsequent to receipt of the wager.

In an embodiment, the gaming system is arranged to notify the player of an opportunity to achieve an event and receive the wager as a response to the offer.

In an embodiment, different wager amounts entitle the player to play for different bonuses.

In an embodiment, the event is selected from the group including:

the order in which the balls are sunk into any of the pockets;

the order in which the balls are sunk into specific pockets;

the order in which a certain subset of the balls are sunk into any pocket; and the order in which a certain subset of balls are sunk into specific pockets.

In a third aspect, the invention provides a gaming apparatus including:

a table including a plurality of pockets, the table adapted for play of a table game of the type where a player seeks to sink one or more balls of a set of balls in one or more of the pockets by striking the balls with a cue ball in accordance with the rules of the table game;

an game play mechanism operable by the player to make a wager additional to any amount required to play the table game, the wager entitling the player to receive at least one bonus associated with an event if the player achieves the event; and a monitoring mechanism arranged to electronically monitor play of the table game to enable a determination of whether the player achieves the event; and a game controller arranged make the bonus award to the player if the player achieves the event.

In an embodiment, the monitoring mechanism is arranged to determine the pocket in which a ball is sunk and the identity of the sunk ball.

In an embodiment, the monitoring device includes a plurality of identification readers associated with respective ones of the plurality of pockets and each ball carries identification data readable by the identification readers.

In an embodiment, the identification readers are radio frequency (RF) readers adapted to read radio frequency identification (RFID) tags embedded in the balls.

In an embodiment, there are a plurality of bonuses associated with respective ones of a plurality of different events.

In an embodiment, an event includes a plurality of sub-events.

In an embodiment, the gaming apparatus is arranged to notify each event to the player prior to commencement of play of the table game.

In an embodiment, the gaming apparatus is arranged to notify each event to the player subsequent to receipt of the wager.

In an embodiment, the gaming apparatus is arranged to notify the player of an opportunity to achieve an event and receive the wager as a response to the offer.

In an embodiment, different wager amounts entitle the player to play for different bonuses.

In a fourth aspect, the invention provides a game controller for a gaming system, the game controller arranged to:

conduct a table game and display the table game on the display, the table game being of the type where a player seeks to sink one or more balls of a set of balls in one or more pockets of the table by striking the balls with a cue ball in accordance with the rules of the table game by operating a game play mechanism;

receive a wager from a player additional to any amount required to play the table game, the wager entitling the player to receive at least one bonus associated with an event if the player achieves the event; and monitor play of the table game to determine whether the player achieves the event and the bonus should be awarded to the player.

In a fifth aspect, the invention provides computer program code which when executed implements the above method.

In a sixth aspect, the invention provides a computer readable medium including the above computer program code.

In a seventh aspect, the invention provides a data signal including computer program code which when executed implements the above method.

In an eighth aspect, the invention extends to transmitting computer program code which when executed implements the above method.

BRIEF DESCRIPTION OF DRAWINGS

Exemplary embodiments are described in conjunction with the following drawings in which.

Figure 1:
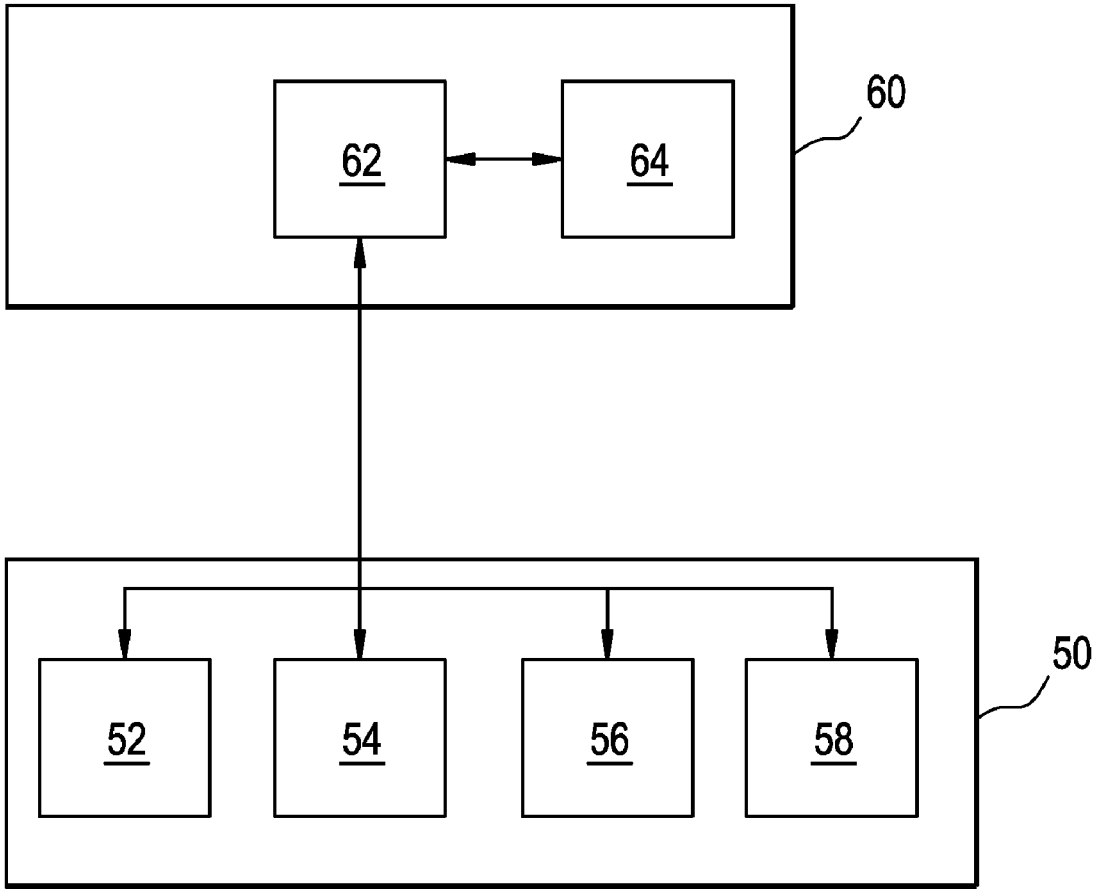
FIG. 1 is a block diagram of the core components of a gaming system of an electronic embodiment.

The foregoing summary, as well as the following detailed description of certain embodiments of the present invention, will be better understood when read in conjunction with the appended drawings. For the purpose of illustrating the invention, certain embodiments are shown in the drawings. It should be understood, however, that the present invention is not limited to the arrangements and instrumentality shown in the attached drawings.

DETAILED DESCRIPTION

Referring to the drawings, there is shown a gaming system and a gaming apparatus arranged to implement a table game where a player seeks to sink one or more balls of a set of balls in one or more pockets of the table by striking the balls with a cue ball in accordance with the rules of the table game. The gaming system and gaming apparatus allow a player to make a wager in addition to any amount required to play the table game. The wager entitles the player to one or more bonuses if the player achieves an event associated with the bonus. The concept can be extended to more than one player. The table game may be, for example 8 Ball pool, 9 ball pool or variants thereof. Common to such games is that a player uses a cue to strike a cue ball in an attempt to sink a target ball in one of the pockets of the table. The rules as to which balls are valid target balls at various stages of the game vary from game to game. Such games can be implemented electronically by displaying a virtual table on a video display and allowing the player to operate a virtual cue stick.

The balls used in such games vary from game to game. In one common implementation of 8 Ball pool, there is a white cue ball and 15 coloured balls each of which bears one of the numbers 1-15 such that each ball is individually identifiable. The balls 1-7 are often known as "solids" as they are entirely of one colour with the exception of an area around the number and the number itself. Each of balls 1-7 is also a different colour (but not black). The 8-Ball is black. Balls 8-15 are often known as "stripes" because they are formed of a coloured portion that extends around an equatorial region of the ball and two white polar portions. Again balls 8-15 are individually coloured (often with the same colours of balls 1-7). Typically, the table is rectangular and has 6 pockets with 4 pockets at respective ones of the corners and 2 pockets positioned midway along respective ones of the longer sides of the tables, however many other tables (whether physical or virtual) have been proposed which could be adapted for use in an embodiment, including round tables, hexagonal tables, L-shaped tables etc.

The gaming apparatus has a physical table with a plurality of pockets and associated electronic components implementing the game. The game can also be implemented electronically as a gaming system.

Gaming Systems

Exemplary Electronic Embodiments

The gaming system can take a number of different forms. In a first form, a stand alone gaming machine is provided wherein all or most components implementing the game are present in a player operable gaming machine.

In a second form, a distributed architecture is provided wherein some of the components implementing the game are present in a player operable gaming machine and some of the components implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Irrespective of the form, the gaming system includes several core components. At the broadest level, the core components are a player interface 50 and a game controller 60 as illustrated in FIG. 1. The player interface is arranged to enable interaction between a player and the gaming system and for this purpose includes the input/output components for the player to enter instructions and play the game.

Components of the player interface may vary from embodiment to embodiment but will typically include a credit mechanism 52 to enable a player to input credits and receive payouts, one or more displays 54, a game play mechanism 56 including one or more input devices that enable a player to input game play instructions (e.g. to place a wager), and one or more speakers 58. The display displays a virtual table having a plurality of pockets. The game play mechanism 56 is arranged to allow a player to play the table game—i.e. to input instructions—in particular to operate a virtual cue to align it to an intended shot and strike the cue ball in an attempt to strike one of the target balls and sink it in a pocket displayed on the display.

The game controller 60 is in data communication with the player interface and typically includes a processor 62 that processes the game play instructions in accordance with game play rules and outputs game play outcomes to the display. Typically, the game play instructions are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server.

Figure 2:
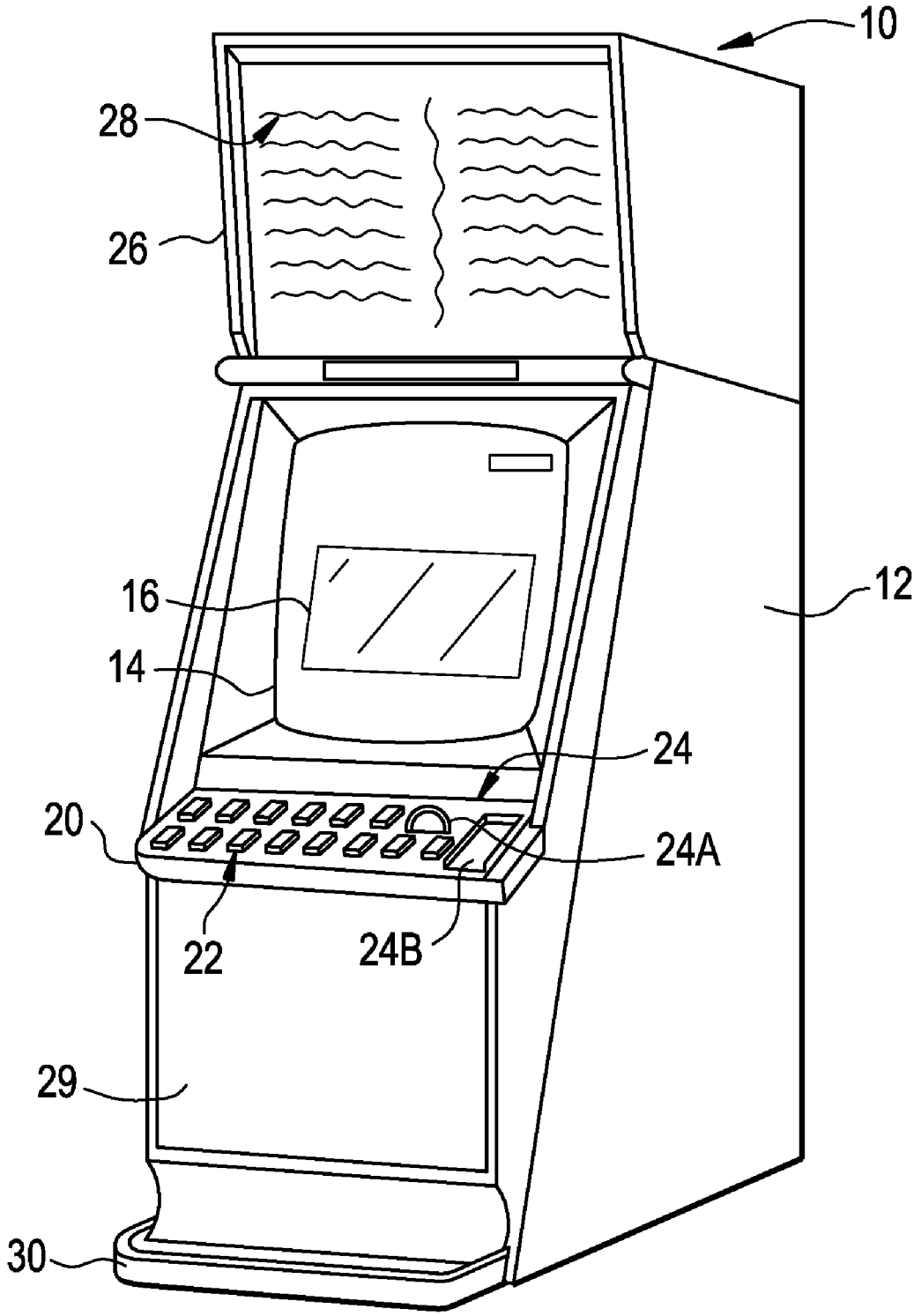
FIG. 2 is a perspective view of a stand alone gaming machine.

A gaming system in the form of a stand alone gaming machine 10 is illustrated in FIG. 2. The gaming machine 10 includes a console 12 having a display 14 on which are displayed representations of the game 16—e.g., including an image of a pool table having a plurality of pockets with balls placed according to the current state of the game. A mid-trim 20 of the gaming machine 10 houses a bank of buttons 22 for enabling a player to interact with the gaming machine, in particular during game play to align the virtual cue and play virtual shots as well as to place wagers. For example, one or more buttons may be operable to adjust the position of the cue stick relative to the cue ball and one or more buttons may be operable to adjust the strength with which the cue strikes the cue ball. The mid-trim 20 also houses a credit input mechanism 24 which in this example includes a coin input chute 24A and a bill collector 24B. Other credit input mechanisms may also be employed, for example, a card reader for reading a smart card, debit card or credit card. A player marketing module (not shown) having a reading device may also be provided for the purpose of reading a player tracking device, for example as part of a loyalty program. The player tracking device may be in the form of a card, flash drive or any other portable storage medium capable of being read by the reading device.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a video display unit, particularly a cathode ray tube screen device. Alternatively, the display 14 may be a liquid crystal display, plasma screen or any other suitable video display unit. The top box 26 may also include a display, for example a video display unit, which may be of the same type as the display 14, or of a different type. The top box 26 may be used to advertise the events achievable by the player.

Figure 3:
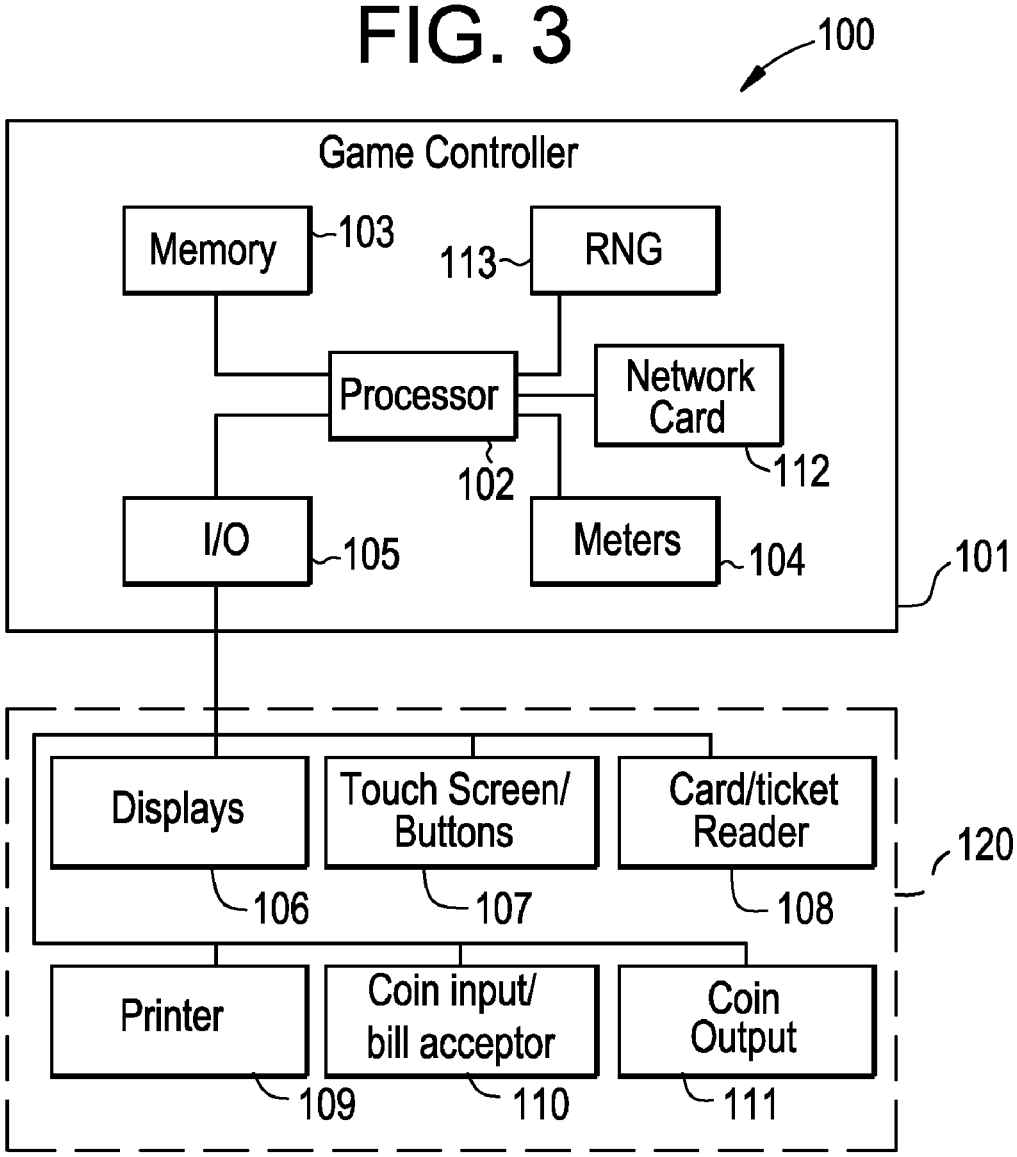
FIG. 3 is a block diagram of the functional components of a gaming machine.

FIG. 3 shows a block diagram of operative components of a typical gaming machine which may be the same as or different to the gaming machine of FIG. 2.

The gaming machine 100 includes a game controller 101 having a processor 102. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 include one or more displays 106, input devices in the form of a touch screen and/or buttons 107, a card and/or ticket reader 108, a printer 109, a bill acceptor and/or coin input mechanism 110 and a coin output mechanism 111. Additional hardware may be included as part of the gaming machine 100, or hardware may be omitted based on the specific implementation. For example, alternative or additional input devices enabling the player to input instructions may be included such as a joy stick controller for adjusting the cue position.

In addition, the gaming machine 100 may include a communications interface, for example a network card 112. The network card may, for example, send status information, accounting information or other information to a central controller, server or database and receive data or commands from the central controller, server or database.

Figure 4:
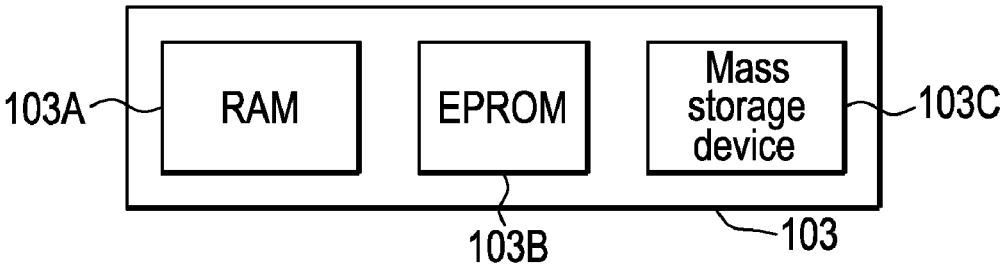
FIG. 4 is a schematic diagram of the functional components of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106, 107, 108, 109, 110, 111 to be provided remotely from the game controller 101.

Figure 5:
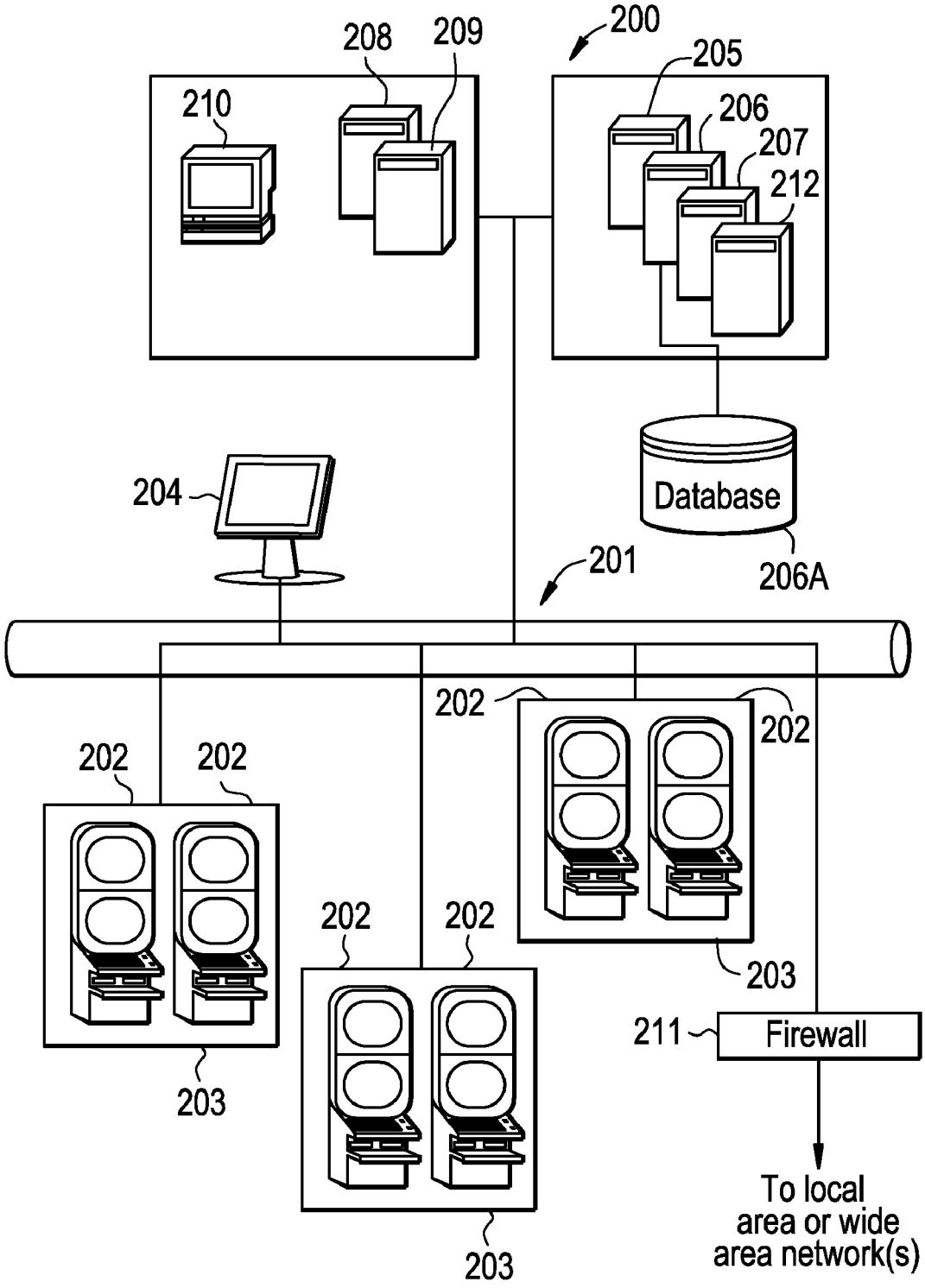
FIG. 5 is a schematic diagram of a network gaming system.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5, are connected to the network 201. The gaming machines 202 provide a player operable interface and may be the same as the gaming machines 10, 100 shown in FIGS. 2 and 3, or may have simplified functionality depending on the rules and/or guidelines for implementing game play. While banks 203 of two gaming machines are illustrated in FIG. 5, banks of one, three or more gaming machines are also envisaged.

One or more displays 204 may also be connected to the network 201. For example, the displays 204 may be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to perform accounting functions for the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of game servers could be provided to run different games or a single game server may run a plurality of different games based on the terminals.

Figure 6:
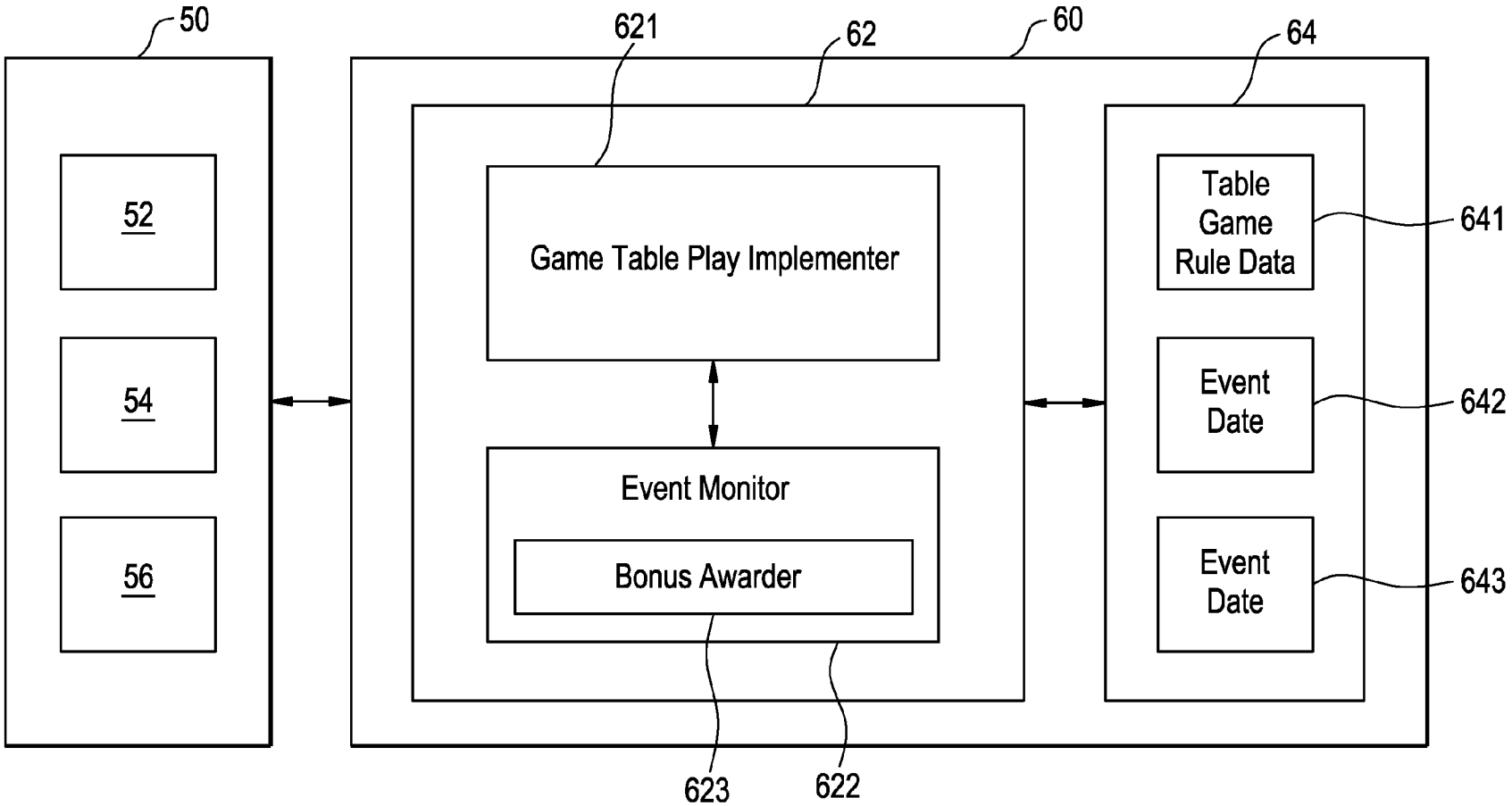
FIG. 6 is a further block diagram of the gaming system.

FIG. 6 shows a gaming system in more detail. A player uses credit mechanism 52 to input credit. The player then operates game play mechanism 56 to pay an entry amount to play the table game, for example by pressing a button or touch screen. The entry amount causes the game controller to activate the table game play implementer module 621, a software routine implemented by processor 62 on the basis of table game rule data 641 stored in memory 64. The game controller 60 controls display 54 to inform the player that they may make a wager to be eligible for bonuses associated with the table game and the player operates game play mechanism 56 to make a wager. The game controller 60 then activates event monitor module 622 which monitors for the events specified by event data 642 in memory 64. That is, it monitors the game play implemented by table game play implementer module 621 to determine whether an event is achieved by a player. If an event is achieved, the bonus awarder 623 operates to advise the player on display 54 that a bonus award has been won. If the bonus is game credits, the bonus awarder 623 updates the meter data 643 to reflect the award.

Appropriate events may be designed to fit the table game in relation to which the bonus is to be awarded. For example, the event may be:

- the order in which the balls are sunk into any of the pockets;
- the order in which the balls are sunk into specific pockets;
- the order in which a certain subset of the balls are sunk into any pocket; or
- the order in which a certain subset of balls are sunk into specific pockets.

It will be appreciated that an event may be composed of a number of sub-events. Typically, the event is chosen so as to be outside the normal rules, such that a player cannot achieve the event in normal play of the game. For example, an event where balls are sunk in order is not as suited to 9-Ball Pool where the normal game rules require the player to shoot at numbered balls in order such that it is not unusual for the balls to be sunk in order. In an embodiment, all events are notified in advance.

In another embodiment, in-game events may be notified during play instead of or in addition to notifying designated events before play. For example, by nominating a designated ball and a designated pocket as an event prior to the player's turn. Such events may run contrary to events advertised at the beginning of the table game, so that, for example if a player achieves the in-game event they may no longer be able to achieve another event, however, the in-game event may be easier to achieve.

In addition to the above, the player may be entitled to certain "free" bonuses which are either made available irrespective of the wager amount or irrespective of whether a wager is made. Typically such bonuses will be of a more minor nature. Different wagers may also entitle a player to play to achieve different or more events.

In multi-player embodiments, each player will be able to place a wager and the gaming controller arranged to nominate which player is to play on display 54.

Exemplary Method

Figure 7:
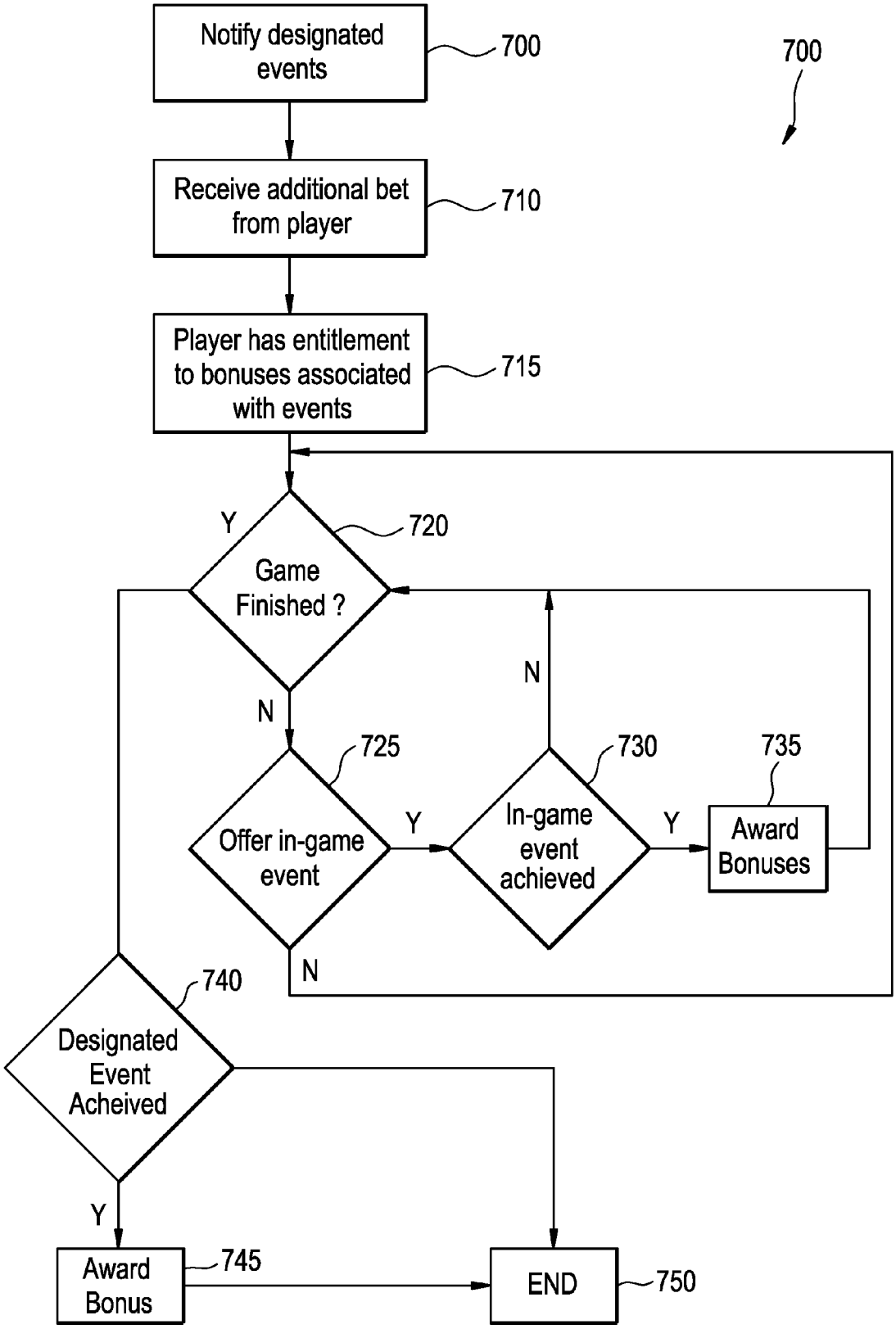
FIG. 7 is a flow chart of an embodiment.

The method 700 is summarised in FIG. 7. The player is notified 705 of designated events that can be achieved. The player makes a wager 710 and becomes entitled 715 to bonuses associated with the events.

The game then begins with the game controller 60 monitoring for events until it determines that the game is finished 720. If the embodiment provides for in-game events, the game controller 60 determines 725 whether to offer an in-game event: for example, based on a random determination prior to each player turn. If an in-game event is offered, it is determined 730 whether it is achieved and if it is achieved a bonus is awarded 735.

The game continues until it is determined 720 that the game has finished, whereafter it is determined 740 whether a predesignated event has been achieved during the game. If an event has been achieved, the bonus is awarded 745 and the game ends 750.

Further features of the method will be apparent from the above description of the gaming system. Persons skilled in the art will also appreciate that the method could be embodied in program code. The program code could be supplied in a number of ways, for example on a computer readable medium, such as a disc or a memory (for example, that could replace part of memory 103) or as a data signal (for example, by downloading it from a server).

Gaming Apparatus

Exemplary Physical Embodiment

Figure 8:
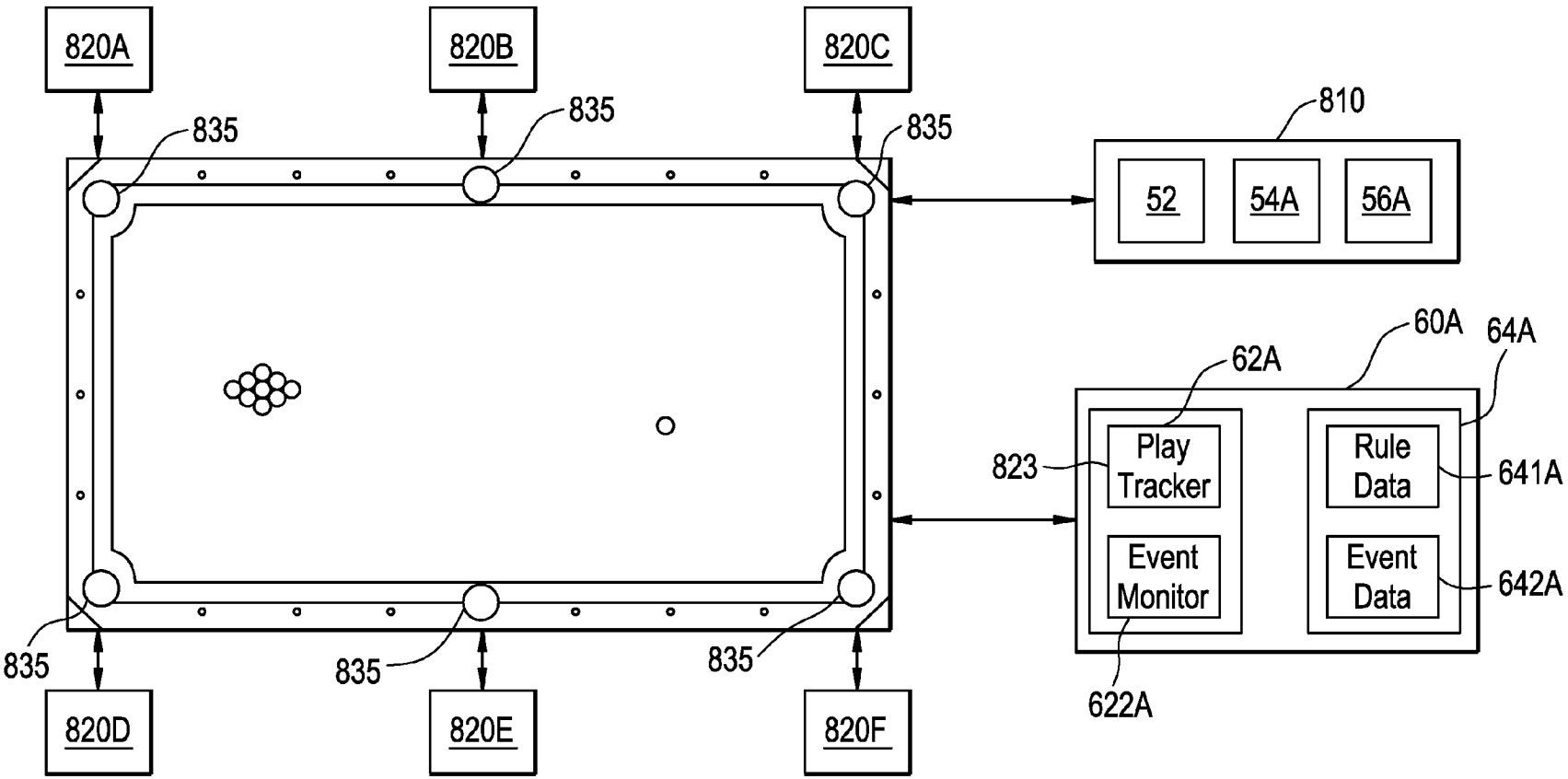
FIG. 8 is a block diagram of a physical embodiment.

As illustrated in FIG. 8, in a physical embodiment (although it will be appreciated that some components are implemented electronically), a gaming apparatus 800 may be formed by replacing the player interface of electronic embodiments with an actual pool table 830 having a plurality of pockets 835, a monitoring mechanism 820 which is able to determine which balls are pocketed in which pocket, and a terminal 810 having a credit mechanism 52A that may be any appropriate device for entering credits such as those exemplified above, and a wagering mechanism 56A, for example buttons or a touch screen interface or other appropriate input device for making a wager. A modified gaming controller 60A implements the other requirements of the gaming apparatus.

In embodiments, where events are advertised in advance, it may be sufficient to provide signage proximate to the gaming machine advising players of the events. In other embodiments, display 54A is used to notify the events to players in much the same way as in the electronic embodiment described above as well as to inform players that bonuses have been awarded.

Accordingly, the game controller 60A may be implemented in a similar manner to that described above in relation to a gaming machine, with modifications to take into account what is in effect a different player interface. In particular, as shown in FIG. 8, the game controller 60A is only required to track game play with game play tracker 823 based on the game rule data 641A stored in memory 64A rather than implementing the game as shown in FIG. 6. The game tracker 823 ensures that game rules are being complied with and determines which player is currently playing in multi-player games, based on the game rules. The display 54A may advise the players whose turn it is.

In this embodiment, the monitoring mechanism includes a plurality of radio frequency tag readers 820 adapted to read radio frequency tags embedded in the balls which identify the balls. The tag readers 820 communicate to the game controller 60 which balls have been read as being sunk is which pocket, whereby the event monitor 622A of the game controller can determine whether an event has been achieved and award bonuses as described above in relation to FIG. 6. In other embodiments, an alternate monitoring mechanism may be used, for example one or more cameras and associated image processing apparatus for resolving the identity of the balls or by placing indicia such as barcodes on the balls which can read automatically by a bar code reader. Persons skilled in the art will appreciate that any appropriate device can be used for the monitoring mechanism provided it can identify individual balls which have entered the pockets based on inherent characteristics of the balls (such as colour) or features added to the balls to enable them to be electronically monitored and discriminated by some form of sensor(s) arranged in an electronic circuit in electrical/data communication with the game controller 60A to communicate data identifying the balls such that the game controller 60A can apply the rules 641A.

Where bonuses are cash prizes, they can be paid out via the credit mechanism in a conventional manner or paid out by an attendant if they exceed a certain amount. The terminal may also include a ticket printer arranged to print tickets having a face value which can be redeemed at a cashier.

EXAMPLES

Example 1

Extra Spend Bonuses at the End of the Game

| Event | Bonus |
|---|---|
| 1. All pockets receive at least one ball | Free Game |
| 2. Balls sunk in the order of their number | $100 |
| 3. All odd numbers sunk before even numbers | $10 |

In this example players would know both the events and bonuses paid before deciding to spend more to qualify for the bonuses.

Example 2

Free Bonuses During the Game

| Event | Bonus |
|---|---|
| 1. Sinking a nominated ball into any pocket | Extra points |
| 2. Sinking any ball into a specific pocket | Extra points |
| 3. Sinking in a nominated ball and pocket | Extra shot |

In this example the player decides whether to go for the event in the hope of gaining an advantage over his opponent. It is also a means whereby players can play by themselves and be challenged by the table.

It will be understood to persons skilled in the art of the invention that many modifications may be made without departing from the spirit and scope of the invention. In particular, that further embodiments can be formed by combining features from the above embodiments and examples.

It is to be understood that, if any prior art publication is referred to herein, such reference does not constitute an admission that the publication forms a part of the common general knowledge in the art, in Australia or any other country.

In the claims which follow and in the preceding description of the invention, except where the context indicates otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It will be appreciated by persons skilled in the art that numerous variations and/or modifications may be made to the invention as shown in the specific embodiments and/or aspects without departing from the spirit or scope of the invention as broadly described. The present embodiments and aspects are, therefore, to be considered in all respects as illustrative and not restrictive. Several embodiments are described above with reference to the drawings. These drawings illustrate certain details of specific embodiments that implement the systems and methods and programs of the present invention. However, describing the invention with drawings should not be construed as imposing on the invention any limitations associated with features shown in the drawings. The present invention contemplates methods, systems and program products on any electronic device and/or machine-readable media suitable for accomplishing its operations. Certain embodiments of the present invention may be implemented using an existing computer processor and/or by a special purpose computer processor incorporated for this or another purpose or by a hardwired system, for example.

Embodiments within the scope of the present invention include program products comprising machine-readable media for carrying or having machine-executable instructions or data structures stored thereon. Such machine-readable media can be any available media that can be accessed by a general purpose or special purpose computer or other machine with a processor. By way of example, such machine-readable media may comprise RAM, ROM, PROM, EPROM, EEPROM, Flash, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such a connection is properly termed a machine-readable medium. Combinations of the above are also included within the scope of machine-readable media. Machine-executable instructions comprise, for example, instructions and data which cause a general purpose computer, special purpose computer, or special purpose processing machines to perform a certain function or group of functions.

The invention claimed is:

1. A method of gaming comprising:

providing a table game of the type where a player seeks to sink one or more balls of a set of balls in one or more pockets of the table by striking the balls with a cue ball in accordance with the rules of the table game;

receiving a wager from a player additional to any amount required to play the table game, the wager entitling the player to receive at least one bonus respectively associated with at least one designated event;

conducting the table game during which, and in response to receiving the wager, offering the player the chance to receive an alternative bonus associated with an in-game event, wherein if the player accepts the offer, the in-game event precludes the player from achieving the designated event; and electronically monitoring play of the table game to determine whether the player achieves the designated event or the in-game event and thereby determining whether the respectively associated bonus should be awarded to the player.

2. A method as claimed in claim 1, wherein there are a plurality of bonuses associated with respective ones of a plurality of different events.

3. A method as claimed in claim 1, wherein an event comprises a plurality of sub-events.

4. A method as claimed in claim 1, comprising notifying each event to the player prior to commencement of play of the table game.

5. A method as claimed in claim 1, comprising notifying each event to the player subsequent to receipt of the wager.

6. A method as claimed in claim 1, comprising notifying the player of an opportunity to achieve an event and receiving the wager as a response to the offer.

7. A method as claimed in claim 2, wherein different wager amounts entitle the player to play for different bonuses.

8. A method as claimed in claim 1, wherein the table game is provided as a video game implemented by a game controller having an associated player interface comprising a display for displaying the table game and a game play mechanism operable by the player to make a wager and play the game.

9. A method as claimed in claim 1, wherein the table game is provided as a physical table, the method further comprising providing a monitoring mechanism arranged to monitor for the event, a game play mechanism operable by the player to make a wager, and a game controller arranged to make the bonus award to the player if the player achieves the event.

10. A method as claimed in claim 1, wherein the event is selected from the group comprising:

the order in which the balls are sunk into any of the pockets;

the order in which the balls are sunk into specific pockets; the order in which a certain subset of the balls are sunk into any pocket; and the order in which a certain subset of balls are sunk into specific pockets.

11. A gaming system comprising:

a player interface comprising a display and a game play mechanism;

a game controller arranged to:

conduct a table game and display the table game on the display, the table game being of the type where a player seeks to sink one or more balls of a set of balls in one or more pockets of the table by striking the balls with a cue ball in accordance with the rules of the table game by operating the game play mechanism;

receive a wager from a player additional to any amount required to play the table game, the wager entitling the player to receive at least one bonus respectively associated with at least one designated event;

conduct the table game during which, and in response to receiving the wager, offer the player the chance to receive an alternative bonus associated with an in-game event, wherein if the player accepts the offer, the in-game event precludes the player from achieving the designated event; and monitor play of the table game to determine whether the player achieves the designated event or the in-game event and thereby determine whether the respectively associated bonus should be awarded to the player.

12. A gaming system as claimed in claim 11, wherein the game controller comprises a table game play implementer arranged to implement play of the table game.

13. A gaming system as claimed in claim 11, wherein the game controller comprises an event monitor arranged to monitor for the occurrence of an event.

14. A gaming system as claimed in claim 11, wherein the game controller comprises a bonus awarder arranged to make an award to the player.

15. A gaming system as claimed in claim 11, wherein there are a plurality of bonuses associated with respective ones of a plurality of different events.

16. A gaming system as claimed in claim 11, wherein an event comprises a plurality of sub-events.

17. A gaming system as claimed in claim 11, arranged to notify each event to the player prior to commencement of play of the table game.

18. A gaming system as claimed in claim 11, arranged to notify each event to the player subsequent to receipt of the wager.

19. A gaming system as claimed in claim 11, arranged to notify the player of an opportunity to achieve an event and receive the wager as a response to the offer.

20. A gaming system as claimed in claim 15, wherein different wager amounts entitle the player to play for different bonuses.

21. A gaming system as claimed in claim 11, wherein the event is selected from the group comprising:

the order in which the balls are sunk into any of the pockets;

the order in which the balls are sunk into specific pockets;

the order in which a certain subset of the balls are sunk into any pocket; and the order in which a certain subset of balls are sunk into specific pockets.

22. A gaming apparatus comprising:

a table comprising a plurality of pockets, the table adapted for play of a table game of the type where a player seeks to sink one or more balls of a set of balls in one or more of the pockets by striking the balls with a cue ball in accordance with the rules of the table game;

an game play mechanism operable by the player to make a wager additional to any amount required to play the table game, the wager entitling the player to receive at least one bonus respectively associated with at least one designated event;

an offering mechanism which, in response to receiving the wager, is to offer the player the chance to receive an alternative bonus associated with an in-game event, wherein if the player accepts the offer, the in-game event precludes the player from achieving the designated event;

a monitoring mechanism arranged to electronically monitor play of the table game to enable a determination of whether the player achieves the designated event or the in-game event; and a game controller arranged make the bonus award to the player if the player achieves the event.

23. A gaming apparatus as claimed in claim 22, wherein the monitoring mechanism is arranged to determine the pocket in which a ball is sunk and the identity of the sunk ball.

24. A gaming apparatus as claimed in claim 22, wherein the monitoring mechanism comprises a plurality of identification readers associated with respective ones of the plurality of pockets and each ball carries identification data readable by the identification readers.

25. A gaming apparatus as claimed in claim 24, wherein the identification readers are RF readers adapted to read RFID tags embedded in the balls.

26. A gaming apparatus as claimed in claim 22, wherein there are a plurality of bonuses associated with respective ones of a plurality of different events.

27. A gaming apparatus as claimed in claim 22, wherein an event comprises a plurality of sub-events.

28. A gaming apparatus as claimed in claim 22, arranged to notify each event to the player prior to commencement of play of the table game.

29. A gaming apparatus as claimed in claim 22, arranged to notify each event to the player subsequent to receipt of the wager.

30. A gaming apparatus as claimed in claim 22, arranged to notify the player of an opportunity to achieve an event and receive the wager as a response to the offer.

31. A gaming apparatus as claimed in claim 26, wherein different wager amounts entitle the player to play for different bonuses.

32. A game controller for a gaming system, the game controller arranged to:

conduct a table game and display the table game on the display, the table game being of the type where a player seeks to sink one or more balls of a set of balls in one or more pockets of the table by striking the balls with a cue ball in accordance with the rules of the table game by operating a game play mechanism;

receive a wager from a player additional to any amount required to play the table game, the wager entitling the player to receive at least one bonus respectively associated with at least one designated event;

offer the player the chance to receive an alternative bonus associated with an in-game event, wherein if the player accepts the offer, the in-game event precludes the player from achieving the designated event; and monitor play of the table game to determine whether the player achieves the designated event or the in-game event and thereby determine whether the respectively associated bonus should be awarded to the player.

33. A non-transitory computer readable medium including computer program code which when executed implements a method for gaming comprising:

providing a table game of the type where a player seeks to sink one or more balls of a set of balls in one or more pockets of the table by striking the balls with a cue ball in accordance with the rules of the table game;

receiving a wager from a player additional to any amount required to play the table game, the wager entitling the player to receive at least one bonus respectively associated with at least one designated event;

conducting the table game during which, and in response to receiving the wager, offering the player the chance to receive an alternative bonus associated with an in-game event, wherein if the player accepts the offer, the in-game event precludes the player from achieving the designated event; and electronically monitoring play of the table game to determine whether the player achieves the designated event or the in-game event and thereby determine whether the respectively associated bonus should be awarded to the player.

* * * * *